US005799550A

United States Patent [19]

Hsieh

[11] Patent Number: 5,799,550

[45] Date of Patent: Sep. 1, 1998

[54] CRESCENT WRENCH

[76] Inventor: Chih-Ching Hsieh, No. 64, Lane 107, Liang Tsun Rd., Fong Yuan City, Taichung Hsien, Taiwan

[21] Appl. No.: 788,414

[22] Filed: Jan. 27, 1997

[51] Int. Cl.[6] ..... B25B 13/34

[52] U.S. Cl. ..... 81/150; 81/129

[58] Field of Search ..... 81/128, 129, 150, 81/151

[56] References Cited

U.S. PATENT DOCUMENTS

| | | | |
|---|---|---|---|
| 696,406 | 4/1902 | Breul | 81/150 |
| 2,829,551 | 4/1958 | Kupis | 81/151 |

FOREIGN PATENT DOCUMENTS

| | | | |
|---|---|---|---|
| 166693 | 7/1921 | United Kingdom | 81/151 |
| 2240502 | 8/1991 | United Kingdom | 81/151 |

*Primary Examiner*—James G. Smith
*Attorney, Agent, or Firm*—Varndell Legal Group

[57] ABSTRACT

A crescent wrench including a steel ball mounted in a hole in a handle and forced by a spring to hold down a movable jaw, a nut mounted in an opening in the handle and turned with the thumb to move a screw rod relative to the movable jaw, permitting the movable jaw to be released from the constraint and moved relative to a fixed jaw at the front end of the handle, or held down at the desired position.

1 Claim, 5 Drawing Sheets

CRESCENT WRENCH

BACKGROUND AND SUMMARY OF THE INVENTION

The present invention relates to crescent wrenches, and more specifically to such a crescent wrench which uses a nut to turn a screw rod forwards and backwards, permitting the movable jaw to be released and moved with the thumb relative to the fixed jaw, or held down at the desired position.

FIG. 1 shows a crescent wrench according to the prior art. This structure of crescent wrench is comprised of a handle having a front end terminating in a fixed jaw, a thumb screw mounted in an opening in the handle near the front end, a movable jaw meshed with the thumb screw and moved by it relative to the fixed jaw. This structure of crescent wrench is still not satisfactory in function. When the crescent wrench is attached to the workpiece after the movable jaw has been adjusted to the desired position, the movable jaw tends to displace, causing the crescent wrench unable to be positively attached to workpiece. If the movable jaw is moved inwards after adjustment, the mouth between the movable jaw and fixed jaw becomes too small to be attached to the workpiece, and the movable jaw shall have to be adjusted again.

The present invention has been accomplished to provide a crescent wrench which eliminates the aforesaid problem. According to the preferred embodiment of the present invention, a steel ball is mounted in a recessed hole in the handle and foced by a spring to engage the movable jaw, a nut is mounted in an opening in the handle and turned with the forefinger to move a screw rod relative to the movable jaw, causing the screw rod to be released from the movable jaw for permitting it to be moved relative to the fixed jaw with the thumb, or to be forced into engagement with the movable jaw to hold down the movable jaw at the desired position.

DETAILED DESCRIPTION OF THE PREFERRED EMBODIMENT

Figure 1:
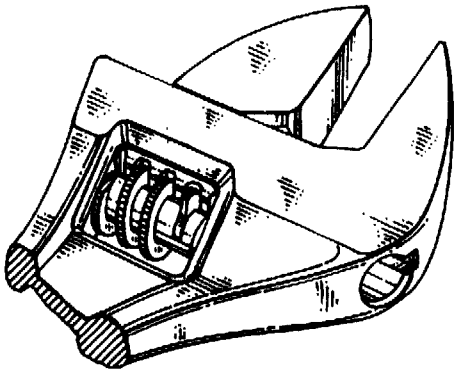
Fig. 1 PRIOR ART
FIG. 1 shows the structure of a crescent wrench according to the prior art.
Figure 2:
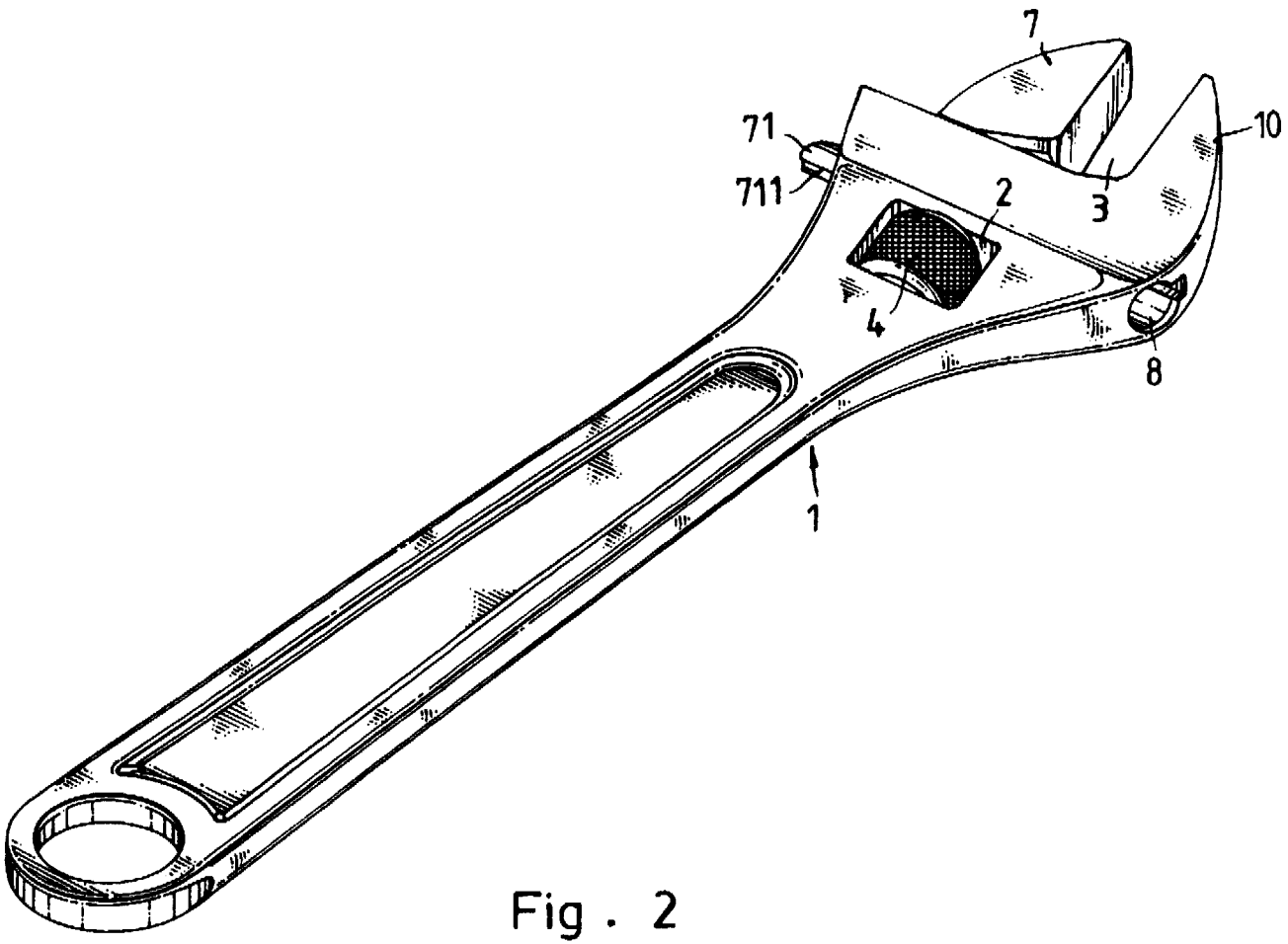
FIG. 2 is an elevational view of a crescent wrench according to the present invention.
Figure 3:
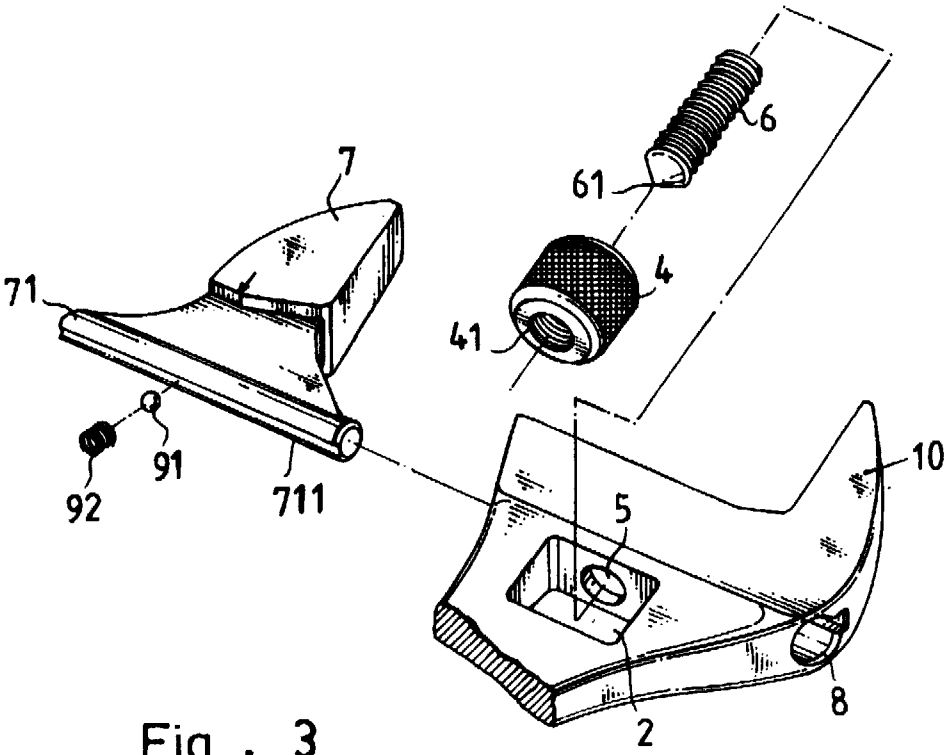
FIG. 3 is an exploded view of the crescent wrench shown in FIG. 2.

Referring to FIGS. from 2 to 4, a crescent wrench in accordance with the present invention is generally comprised of a handle 1 having a front end terminating in a fixed jaw 10, a nut 4, a screw rod 6, a steel ball 91, a spring 92, and a movable jaw 7. The movable jaw 7 is moved relative to the fixed jaw 10 of the handle 1 to adjust the mouth 3 therebetween.

The handle 1 has an opening 2 near the front end, a transverse slot 8 disposed between the fixed jaw 10 and the opening 2, a recessed hole 9 perpendicularly extended from the transverse slot 8, a longitudinal through hole 5 connected between the opening 2 and the transverse slot 8, and a longitudinal receiving hole 5' extended from one side of the opening 2 opposite to and in longitudinal alignment with the longitudinal through bole 5. The nut 4 is mounted within the opening 2. The screw rod 6 is inserted through the longitudinal through hole 5 and threaded into the inner thread 41 of the nut 4, having a tapered front end 61 moved into the longitudinal receiving hole 5'. The shape of the longitudinal receiving hole 5' fits the front end of the screw rod 6. The movable jaw 7 has an axle 71 at one end moved in the transverse slot 8 of the handle 1. The axle 71 of the movable jaw 7 has a longitudinal locating groove 711. The steel ball 91 is supported on the spring 92 in the recessed hole 9. The spring 92 imparts an outward pressure to the steel ball 91, causing it to engage the longitudinal locating groove 711 of the axle 71 of the movable jaw 7.

Figure 4:
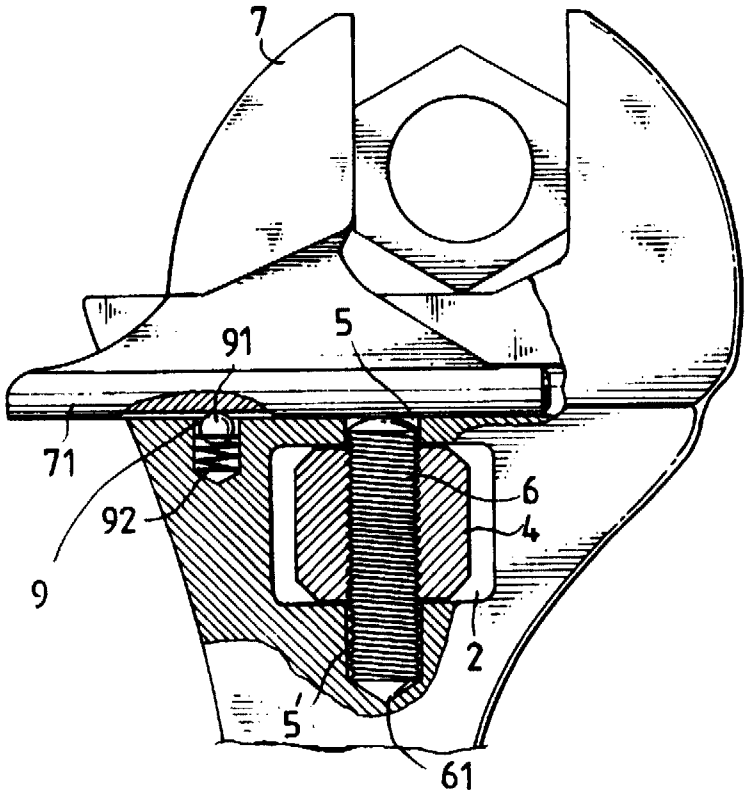
FIG. 4 is a top view in section in an enlarged scale of a part of the crescent wrench shown in FIG. 2.
Figure 5:
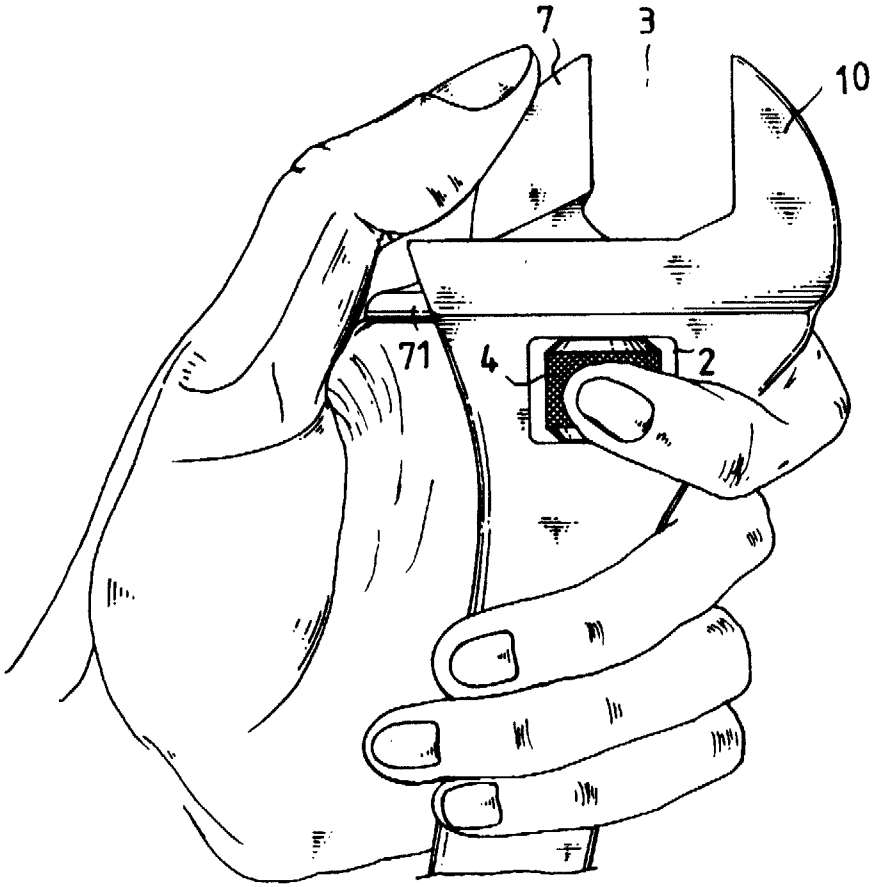
FIG. 5 is an applied view of the present invention, showing the crescent wrench operated.

Referring to FIGS. 5 and FIG. 4 again, when in use, the nut 4 can be turned with the forefinger to move the screw rod 6 forwards or backwards in the longitudinal through hole 5 relative to the axle 71 of the movable jaw 7. When the screw rod 6 is moved backwardly away from the axle 71 of the movable jaw 7, the movable jaw 7 can then be moved with the thumb relative to the fixed jaw 10, permitting the mouth 3 to be adjusted subject to the size of the workpiece for example a hexagonal bolt to be turned. When the fixed jaw 10 and the movable jaw 7 are respectively attached to two opposite sides of the head of the hexagonal bolt, the nut 4 is turned reversely to move the screw rod 6 forwards, causing it to engage the axle 71 of the movable jaw 7, and therefore the hexagoanl bolt can be positively turned by the crescent wrench.

I claim:

1. A crescent wrench comprising a handle having a front end terminating in a fixed jaw, a movable jaw moved relative to said fixed jaw and adapted to match with said fixed jaw for turning things, and a mechanism adapted for moving said movable jaw relative to said fixed jaw and holding it down at the desired position, wherein:

said handle comprises an opening near its front end, a transverse slot disposed between said fixed jaw and said opening, a recessed hole perpendicularly extended from said transverse slot, a longitudinal through hole connected between said opening and said transverse slot, and a longitudinal receiving hole extended from one side of said opening opposite to and in longitudinal alignment with said longitudinal through hole;

said movable jaw has an axle at one end moved in the transverse slot of said handle, said movable jaw having a longitudinal locating groove;

said mechanism comprises a spring mounted in the recessed hole of said handle, a steel ball forced by said spring into engagement with the longitudinal groove of the axle of said movable jaw, a nut mounted within the opening of said handle, and a screw rod inserted through the longitudinal through hole and longitudinal receiving hole of said handle and threaded into said nut, said screw rod being turned by said nut to move said screw rod in and out of the transverse slot of said handle, causing said screw rod to hold down or release said movable jaw.

* * * * *